US005842530A

United States Patent [19]

Smith et al.

[11] Patent Number: 5,842,530

[45] Date of Patent: Dec. 1, 1998

[54] HYBRID COILED TUBING/CONVENTIONAL DRILLING UNIT

[75] Inventors: Donald A. Smith; Douglas Costall, both of Okotoks, Canada

[73] Assignee: Canadian Fracmaster Ltd., Canada

[21] Appl. No.: 740,763

[22] Filed: Nov. 1, 1996

Related U.S. Application Data

[60] Provisional application No. 60/006,243 Nov. 3, 1995.

[51] Int. Cl. [6] ..... E21B 33/00

[52] U.S. Cl. ..... 175/162; 166/77.2

[58] Field of Search ..... 175/162, 87, 173; 166/77.2, 77.3, 384

[56] References Cited

U.S. PATENT DOCUMENTS 3,516,183 6/1970 Serota ..... 175/162 X
5,103,912 4/1992 Flint ..... 166/384 X
5,215,151 6/1993 Smith et al. ..... 175/45
5,244,046 9/1993 Council et al. ..... 166/77.2 X
5,411,085 5/1995 Moore et al. ..... 166/77.2 X
5,454,419 10/1995 Vloedman ..... 166/77.2 X

*Primary Examiner*—William P. Neuder
*Attorney, Agent, or Firm*—Lerner, David, Littenberg, Krumholz & Mentlik

[57] ABSTRACT

There is described an apparatus for the drilling and servicing of bore holes in the earth, comprising a first sub-assembly adapted for the drilling and servicing of bore holes using jointed and coiled tubing, a second sub-assembly adapted for the drilling and servicing of bore holes using a continuous length of coiled tubing, and a platform adapted to support the first and second sub-assemblies thereon.

12 Claims, 5 Drawing Sheets

3
2
25
31
30
5
70
75
35
44
50
43
46
11
1
9
8
15
7
6
41
19
120
18
40
22
14
27
28
23
39
13
47
24
111

HYBRID COILED TUBING/CONVENTIONAL DRILLING UNIT

FIELD OF THE INVENTION

This Application is based on U.S. provisional application No. 60/006,243 filed Nov. 3, 1995.

The present invention relates to a mobile drilling unit and more particularly to a unit mounted on a single mobile platform capable of both coiled tubing and conventional drilling and servicing of bore holes.

BACKGROUND OF THE INVENTION

Increasingly, the drilling of oil and gas wells is no longer a matter of drilling a vertically straight bore hole from the surface to the zone of hydrocarbon recovery using a traditional drilling platform surmounted by a derrick, the derrick supporting a string of jointed drill pipe with a bit connected to the lower end of the string. Rather, technology and techniques have been developed to deviate the bore's trajectory at angles of up to and sometimes exceeding 90° from the vertical. Directional drilling offers numerous advantages including new approaches to oil and gas traps having non-conventional geometries, economic zone enhancement as can occur for example if the bore hole actually follows an oil or gas bearing strata, improved economics particularly in an over-pressured environment (when formation pressure is sufficient to force hydrocarbons to the surface at potentially explosive rates) and reduced environmental degradation.

After deviating a bore hole from the vertical, it's obviously no longer completely practical to sustain continuous drilling operations by rotating the drill string and the connected bit. Preferably, only the bit, but not the string, is rotated by a downhole motor attached to the lower end of the string, the motor typically consisting of a rotor-stator to generate torque as drilling fluid passes therethrough, a bent housing to deviate the hole by the required amount and which also encloses a drive shaft therethrough to transmit the rotor/stator's torque to a bearing assembly, and a bit rotatably supported at the downhole end of the bearing assembly for cutting the bore hole. This equipment all forms part of a bottom hole assembly (BHA).

Electronic means supported by a mule shoe in the bottom hole assembly and connected to the surface by a wire line passing through the interior of the drill string transmits information with respect to the degree and azimuth of the bore hole's trajectory so that it can be plotted and necessary adjustments made. Sometimes these adjustments require changing of the BHA, in which event the drill string must be tripped out and then back into the well. Each time the motor requires service, or a change in the hole's trajectory is required, this process must be repeated. This results in substantial costs and down time largely due to the time required to make and break all of the joints as the drill string is tripped in and out of the hole.

SUMMARY OF THE INVENTION

To overcome this problem, discrete lengths of jointed drill pipe are replaced whenever feasible with coiled tubing which is a single length of continuous, unjointed tubing spooled onto a reel for storage in sufficient quantity to exceed the maximum length of the bore hole being drilled. The injection and withdrawal of the tubing can be accomplished more rapidly in comparison with conventional drill pipe due in large part to the elimination of joints. However, as with conventional pipe, drilling mud and wire lines for downhole instrumentation pass through the tubing's interior.

Coiled tubing has been extensively used for well servicing as well as for workovers within previously drilled holes.

More recently, tools and methods have been developed for the actual drilling of bore holes using coiled tubing and reference is made in this regard to U.S. Pat. No. 5,215,151 describing one such system.

Nevertheless, and even though the results of coiled tubing drilling to date indicate that this method might eventually replace conventional jointed pipe technology, coiled tubing drilling technology is still being perfected and remains virtually in its infancy. Conventional and coiled tubing drilling continue therefore to co-exist and will for some time. Because coiled tubing drilling technology is still nascent, there have been until now no significant advances in providing equipment capable of performing both conventional and coiled tubing drilling in a combination unit for a complete drilling and pipe handling service.

It is therefore an object of the present invention to provide a self-contained unit that facilitates the safe handling of both flexible coiled tubing and conventional jointed pipe. In a preferred embodiment, the present invention provides a drilling unit for coiled tubing drilling including a mobile collapsible sub-structure and a derrick mounted on a single mobile platform such as a wheeled or tracked trailer. The unit is therefore fully functional for coiled tubing drilling in an underbalanced (over-pressured) or balanced condition and will also handle conventional jointed pipe for drilling with a mud motor or power swivel.

When the coiled tubing drilling system is not in use, the unit can be used for pulling and running jointed pipe such as tubing and casing by using the main draw works as in a conventional operation. The present unit can be mounted on a tridem trailer and is adapted to mechanically fold down to legal transport dimensions. Preferred features include the rear of the trailer being designed to encompass the wellhead and blowout preventers with the mast situated directly overhead, a two-legged mast, a collapsible sub-floor to hold the tubing injector on a hydraulically controlled, telescopically adjustable injector frame with the collapsible sub-floor being movable into place using the mast's main draw works, the sub-floor also acting as a work platform for the operating personnel, and a pin arrangement that can be used to removably mount the tubing injector to the injector frame. The pin arrangement is telescopically associated with the frame and can be raised or lowered by the blocks in the mast when the car is positioned over the wellhead and underneath the injector. Power tongs are suspended from the mast by a cable operated from a jib crane.

Having a mast block for raising and lowering equipment can eliminate the need for a separate crane at the well site.

In another preferred embodiment, the telescopic frame for the tubing injector is supported on rails where it can be controlled and moved hydraulically which allows for remote control as well as quicker and easier positioning of the injector than is currently possible on existing systems. Since all functions can be controlled hydraulically, the present unit is capable of operating with reduced manpower compared to conventional rigs. The ability to operate the equipment remotely eliminates the need to have personnel on the floor during drilling operations.

Thus, the present unit with its flexibility of handling heights and weights of all required equipment including both types of tubing can substantially reduce the amount of equipment on location, reduce drilling time and facilitate a safe way to drill in underbalanced conditions. As well, rigging in and out times are substantially reduced. The mast is also capable of handling BHA's, a lubricator for pressure deployment, the running of jointed pipe and it can also support the tubing string weight in the sub-floor itself.

According to the present invention then, there is provided apparatus for the drilling and servicing of bore holes in the earth, comprising a first sub-assembly adapted for the drilling and servicing of bore holes using jointed and coiled tubing, a second sub-assembly adapted for the drilling and servicing of bore holes using a continuous length of coiled tubing, and platform means adapted to support said first and second sub-assemblies thereon.

BRIEF DESCRIPTION OF THE DRAWINGS

Preferred embodiments of the present invention will now be described in greater detail and will be better understood when read in conjunction with the following drawings, in which.

DETAILED DESCRIPTION

Figures 1, 2:
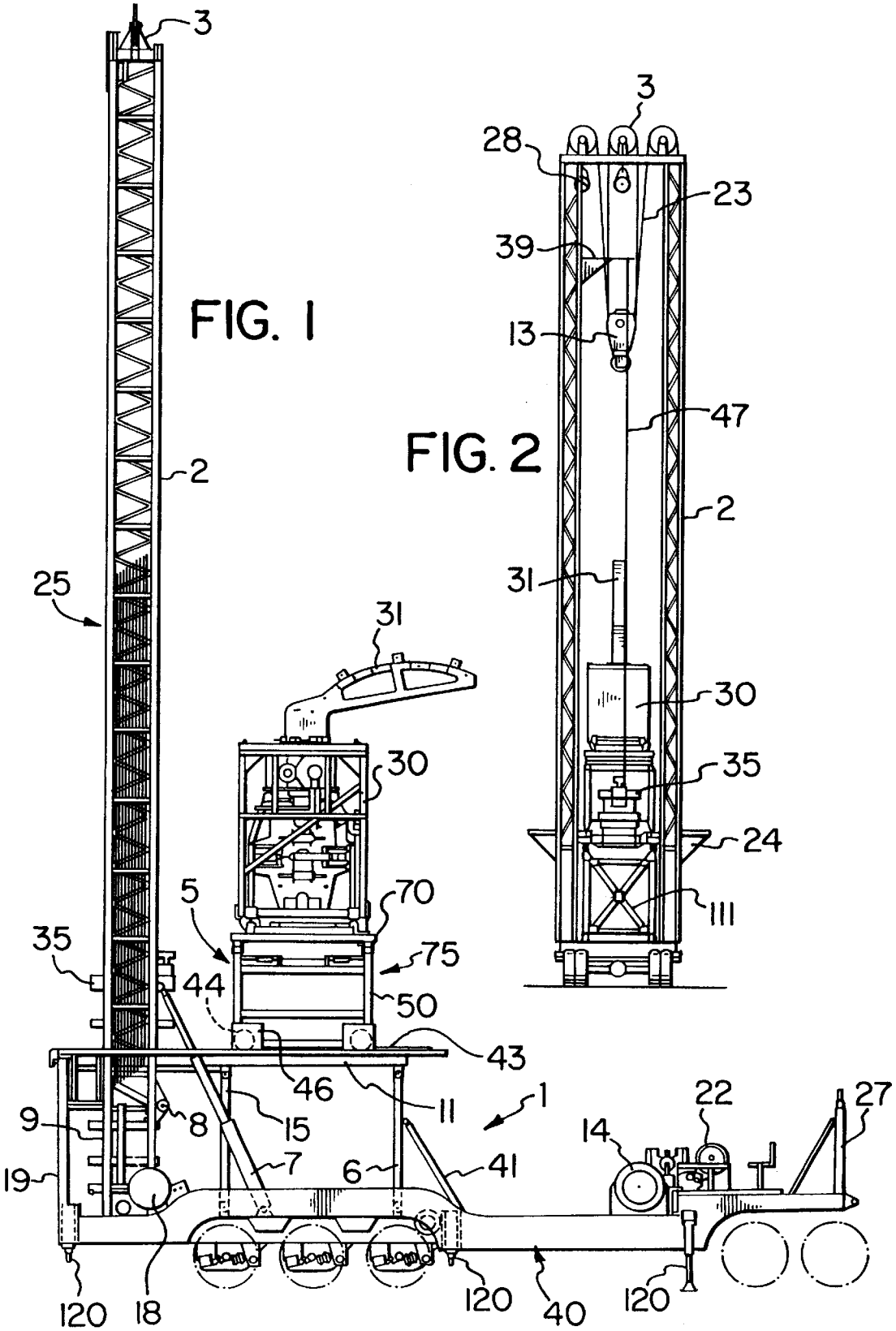
FIG. 1 is a side elevational partially schematic view of the present hybrid unit with the derrick in a raised position.
FIG. 2 is a schematical rear elevational view of the unit of FIG. 1.
Figure 3:
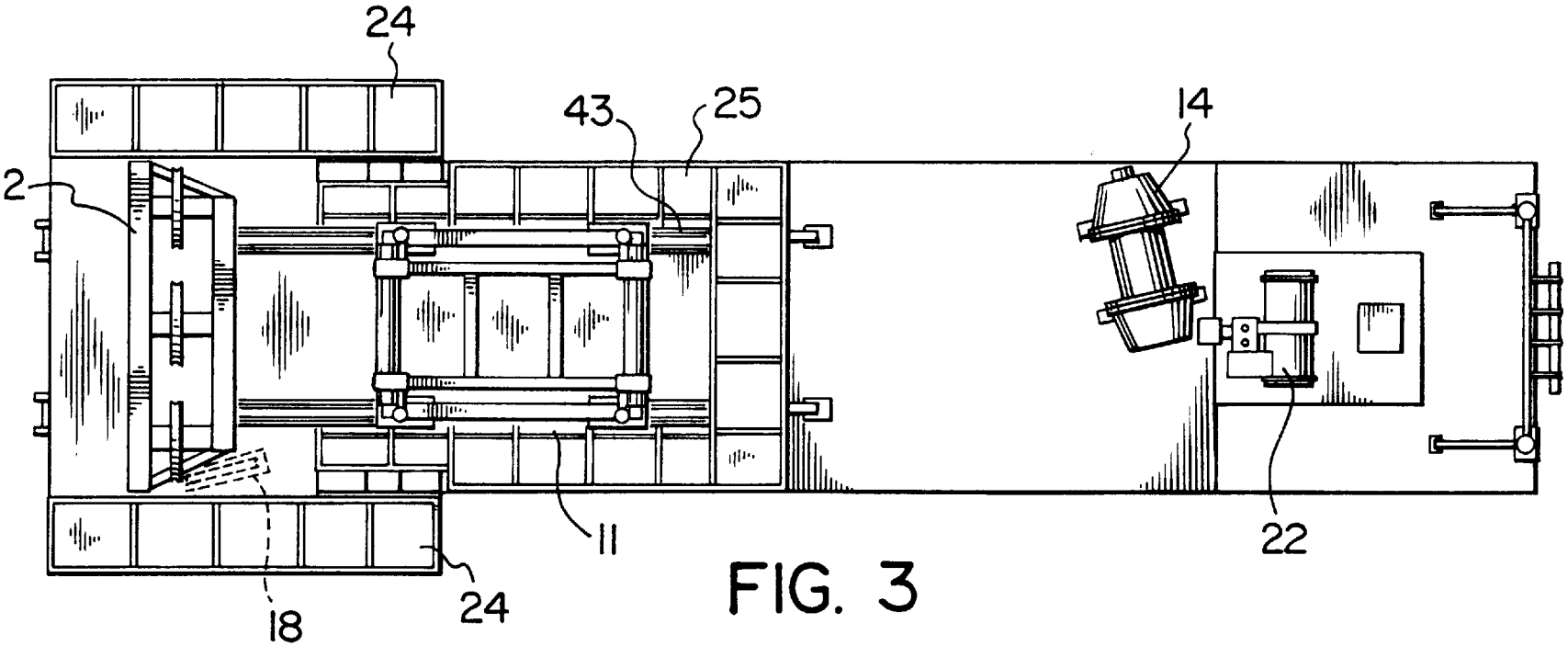
FIG. 3 is a plan view of the hybrid unit of FIG. 1.

With reference to the drawings, FIGS. 1, 2 and 3 show the present unit 1 deployed for drilling. The unit comprises, generally, a trailer 40, which may be wheeled, tracked or skidded which supports a first sub-assembly 25 for conventional jointed pipe drilling and a second sub-assembly 75 for coiled tubing drilling.

Figure 4:
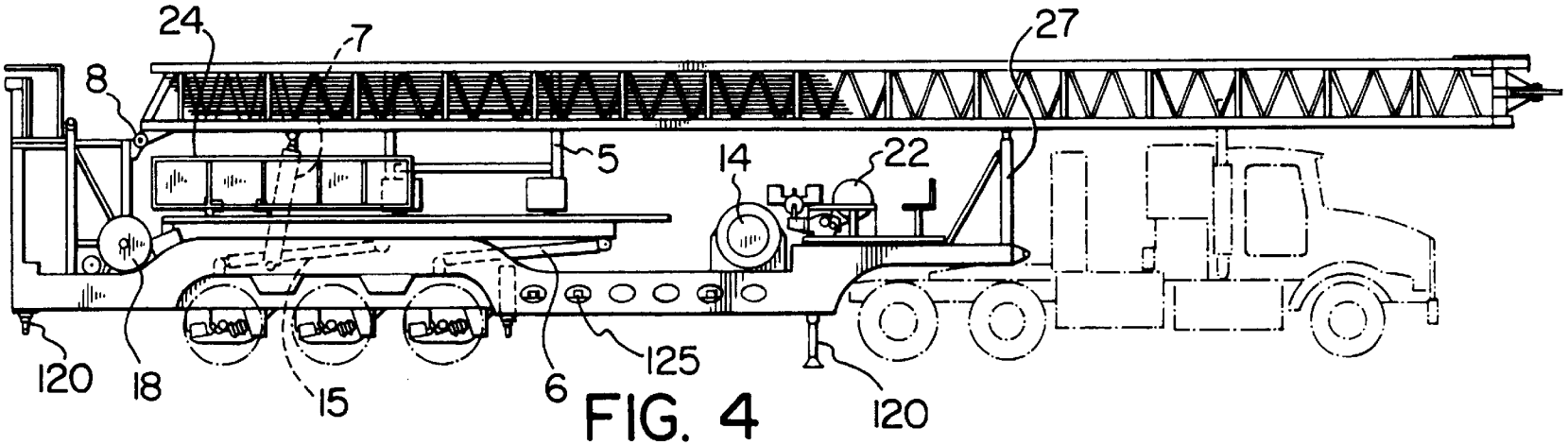
FIG. 4 is a side elevational view of the hybrid drilling unit of FIG. 1 in a collapsed transport mode.
Figure 5:
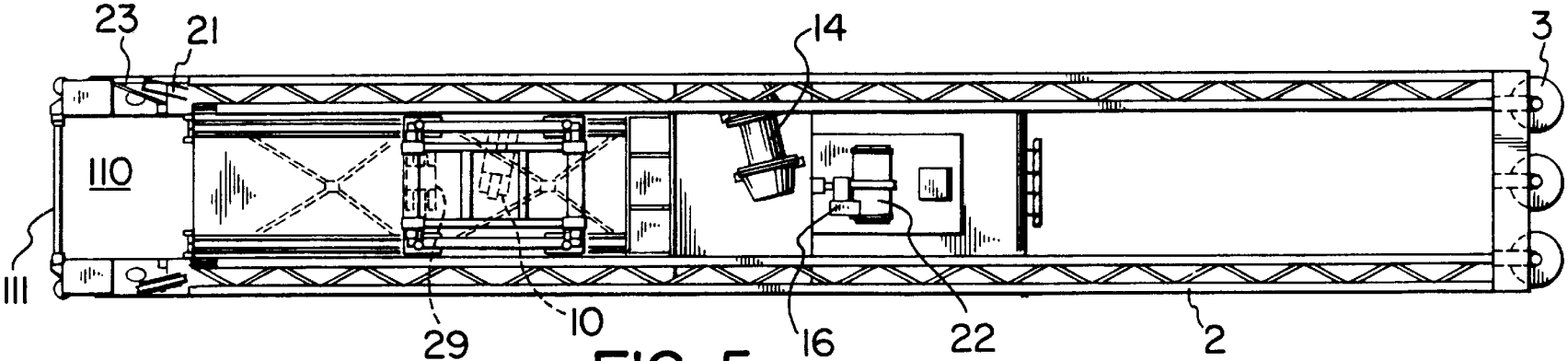
FIG. 5 is a plan view of the hybrid drilling unit of FIG. 4 in the transport mode.
Figure 6:
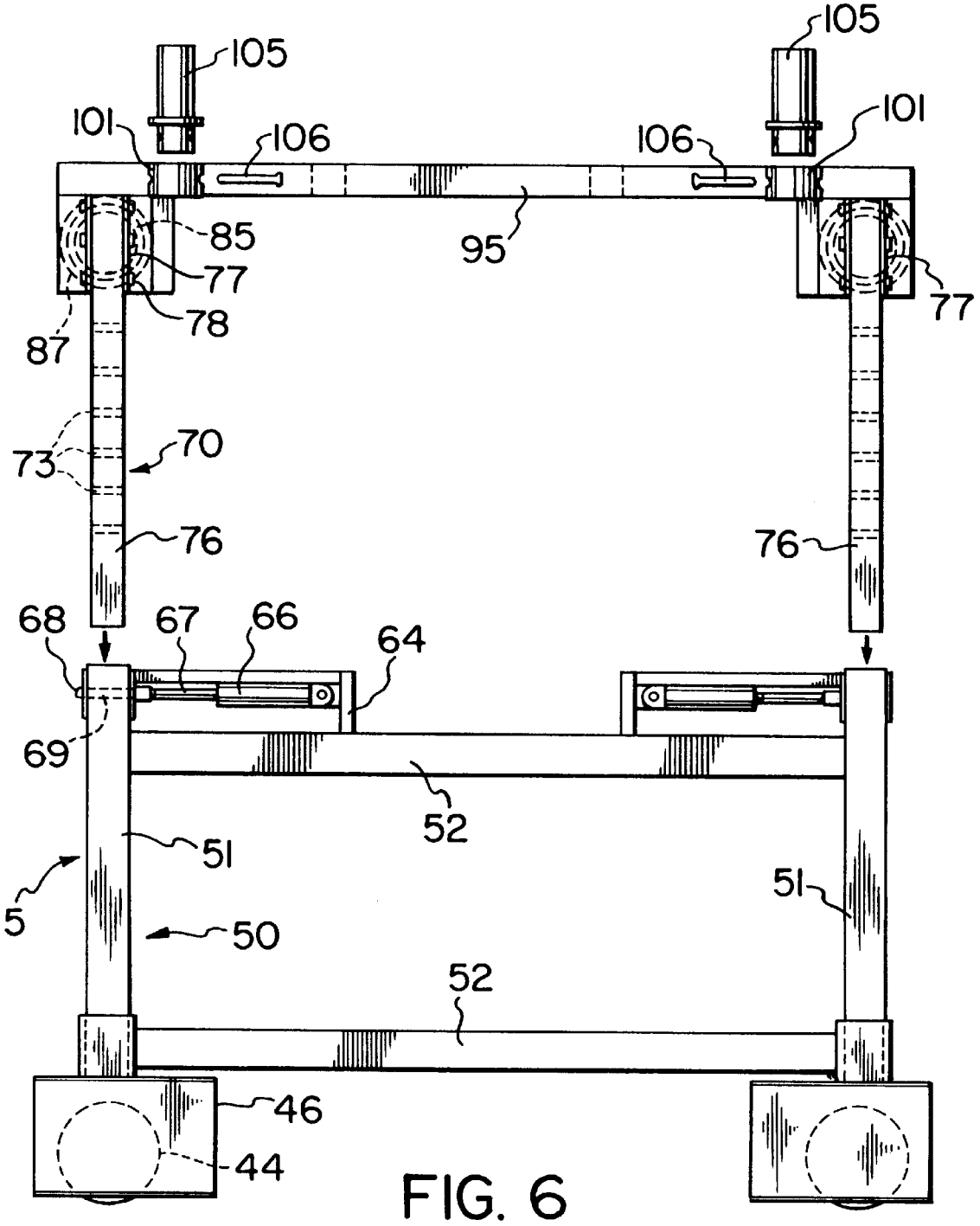
FIG. 6 is a side elevational, partially exploded view of a telescopic injector frame forming part of the present unit.
Figure 7:
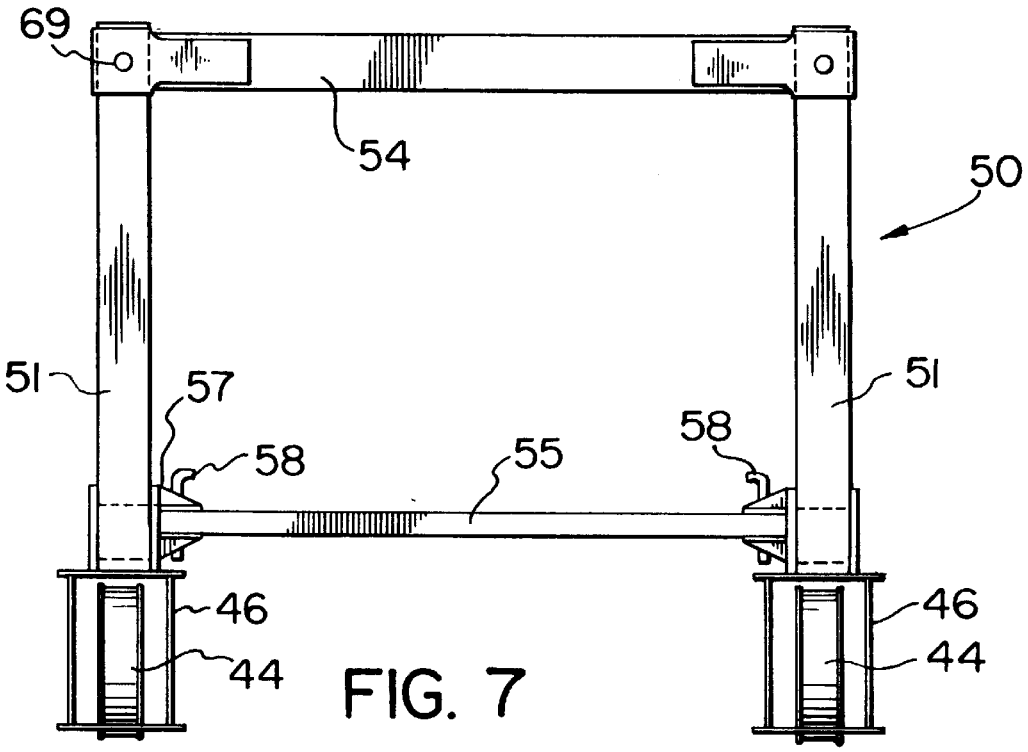
FIG. 7 is an end elevational view of the base frame of the frame assembly of FIG. 6.
Figure 8:
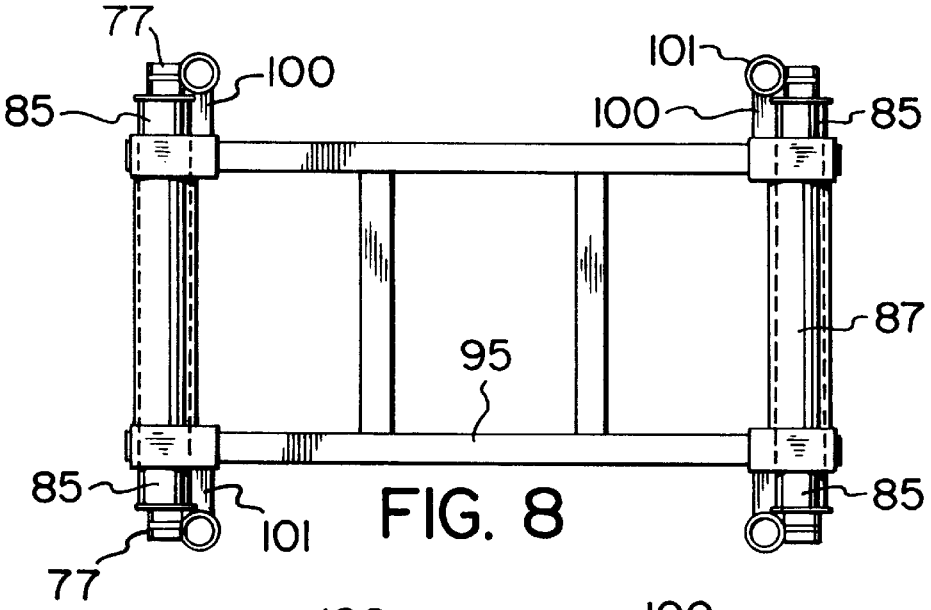
FIG. 8 is a plan view of the frame of FIG. 6.
Figure 9:
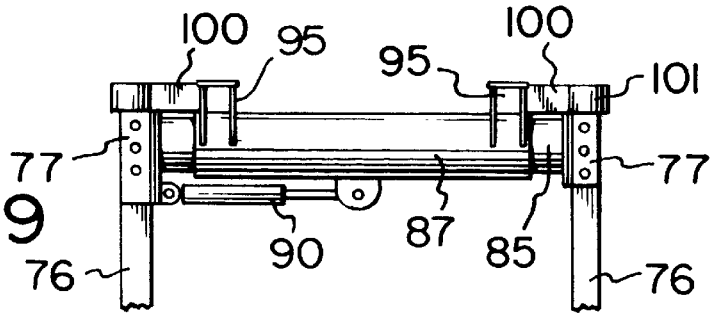
FIG. 9 is an end elevational view of the teleframe portion of the frame of FIG. 6.

First sub-assembly 25 includes a pivotable derrick or mast 2 having the usual crown and sheaves 3, block hook 13 and a mast raising hydraulic ram 7. Ram 7 pivots mast 2 about a hinge 8 on lower mast frame 9 between the raised position of the mast shown in FIG. 1 and the lowered, transport position shown in FIG. 4. The mast additionally includes a wire rope 23 for raising and lowering hook 13, some cat line blocks 28 and a jib crane 39 with its own wire rope 47 for suspending power tongs and a backup 35 from the rear of the mast. Hook 13 is raised and lowered by wire rope 23 actuated by a main winch or draw works 14. The unit also includes a separate cat line winch 10 (FIG. 5). A spool 16 (FIG. 5) is provided for wire rope storage and adjacent the spool is a slick line winch 22. A fast line sheave 18 is provided at the base of lower mast frame 9. As best seen in FIG. 5, trailer 40 also supports a wire rope anchor 21 and a catline sheave 23.

Sub-assembly 75 for coil tubing drilling is supported on a collapsible sub-floor 11 which sits atop front pivot legs 6, back pivot legs 15 and back legs 19. With sub-floor 11 in the position shown in FIG. 1, the sub-floor is anchored to the tops of non-pivoting back legs 19 such as by means of pins and is additionally supported in the upright position by removable diagonal braces 41. A telescopic injector frame 5 is movably supported in floor 11 forwardly of mast 2 by means of rails 43 in the sub-floor and cooperating trolley-type wheels 44 on the frame. The frame therefore becomes an adjustable trolley car that supports a coiled tubing drilling injector 30 thereon, the injector including a guide arch 31 that guides the coiled tubing from a coiled tubing storage reel (not shown) into the injector. Injector 30 and frame 5 can be connected to one another by a pin arrangement. The injector can be raised and lowered relative to the frame using hook 13 suspended from mast 2.

Frame 5 is telescopic for adjustments to the height of injector 30 above sub-floor 11. Reference is made to FIGS. 6 to 9 showing frame 5 in greater detail, the frame comprising two main sub-assemblies, a base frame 50 and a telescopically associated teleframe 70. As seen particularly from FIGS. 6 and 7, base frame 50 is generally an open rectangular frame work including four hollow uprights 51, fixed upper and lower cross members 52, fixed cross members 54 spanning the width of the frame and removable lower cross bars 55, the ends of which connect to brackets 57 on the uprights by means of retractable pins 58. Wheels 44 are located at the lower ends of the uprights and are rotatably mounted within protective housings 46.

Upper cross members 52 are set down from the tops of the uprights to provide clearance for brackets 64 that support horizontally aligned hydraulic cylinders 66. The piston rods 67 of each cylinder support a locking pin 68 oriented to pass through holes 69 in the uprights. As will be described below, these pins also pass through holes in the uprights of the teleframe so that its position relative to the base frame can be adjusted.

With reference once again to FIG. 6, teleframe 70 includes four uprights 76 each of which is sized to be telescopically and slidably received into respective ones of uprights 51 on base frame 50. Each upright is formed with a plurality of holes 73 spaced apart at predetermined intervals to selectively align with the holes 69 in uprights 51 for insertion of pins 68. The top of each upright 76 is "boxed" in by a rectangular metal box sleeve 77 connected to the tops of the uprights such as by means of nuts and bolts 78. The sleeves act as stops to limit the insertion of the teleframe uprights into the base frame uprights and also as points of connection for the ends of cylinders 85, seen best in FIGS. 8 and 9, extending across the width of the teleframe adjacent each of its ends. Each of the cylinders 85 slidably supports an annular sleeve 87, the length of which is less than the distance between adjacent bracketing box sleeves 77. These annular sleeves can therefore move from side to side along respective cylinders 85. This movement can be controlled hydraulically by co-acting hydraulic cylinders 90 connected between a box sleeve 77 and a respective annular sleeve 87 as shown most clearly in FIG. 9.

A longitudinally extending ladder frame 95 is rigidly connected to and between annular sleeves 87 for movement in tandem with these sleeves. Welded or otherwise rigidly connected to the ladder frame adjacent its corners are extensions 100, each of which supports one or more vertically oriented tubular sleeves 101. Each sleeve is adapted to receive a flanged and chamfered pin 105 which is connected to the sleeve for example by means of a retractable pin 106. Injector 30 is adapted to engage these pins when lowered onto frame 5. The position of the injector relative to mast 2 can therefore be adjusted both in the back-and-forth directions by movement of frame 5 along rails 43, and from side-to-side by movement of sleeves 87 along cylinders 85. These adjustments are useful to more precisely align the injector with the wellhead. Adjustments to the height of the injector are made by suspending the injector from hook 13, activating cylinders 66 to withdraw locking pins 68, using mast 2 to raise or lower the injector the required amount to align selected holes 73 with holes 69 in the base frame's uprights and reactivating the cylinders to reinsert the locking pins. Obviously, the height of the teleframe can be adjusted before or after installation of the injector.

As mentioned previously, the rear of trailer 40 is designed to encompass a wellhead and/or blowout preventers. This will be seen most clearly from FIG. 5 showing the trailer from above with the mast collapsed into its transport position. As will be seen, the end of the trailer defines a bay 110 that is positioned about the wellhead/blowout preventers. A removable gate 111 is opened when positioning the trailer, and is closed after positioning of the unit. With reference to FIG. 4, the unit is provided with levelling jacks 120 and hydraulic controls 125 can be conveniently located in the sides of the trailer. The units' hydraulics are conventional and will be apparent to those skilled in the art without the need for further detailed description. Trailer 40 will also include all of the usual equipment and hookups for electrical power, well logging, controls, safety equipment and so forth. These systems are known in the art, and a detailed description is therefore being omitted.

A remotely controlled tubing pulling winch 29 located directly underneath collapsible floor 11 within trailer frame 40 is used for pulling the coil tubing over the guide arch 31 into injector 30.

Collapsible floor 11 incorporates a working platform 25 including foldable platform extensions 24 provided about each of sub-assemblies 25 and 75 for operating personnel. Collapsible sub-floor 11, including frame 5, is slung or pivoted into the position shown in FIG. 1 using the main draw works of mast 2. The floor can be similarly lowered into the collapsed transport position shown in FIG. 4 using the draw works after the floor is disconnected from back legs 19 and braces 41 removed. As will be seen from FIG. 4, in this collapsed position, front pivot legs 6 and back pivot legs 15 are folded over about their respective pivot points to lie atop the trailer's flat bed. Platform extensions 24 are folded up to be out of the way for transport purposes. Injector 30 and guide arch 31 are removed from the unit prior to collapse into the transport mode. Mast supports 27 support the upper end of mast 2 when lowered into the transport position again shown in FIG. 4.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

We claim:

1. Apparatus for the drilling and servicing of bore holes in the earth, comprising:

a first sub-assembly adapted for the drilling and servicing of bore holes using jointed pipe and tubing;

a second sub-assembly adapted for the drilling and servicing of bore holes using a continuous length of coiled tubing; and platform means adapted to support said first and second sub-assemblies thereon.

2. The apparatus of claim 1 wherein said second sub-assembly is supported for movement between a first lowered position for storage and transport of said apparatus, and a second raised position for drilling and servicing operations.

3. The apparatus of claim 2 wherein said second sub-assembly is provided on floor means, said floor means being pivotable between said first and second positions.

4. The apparatus of claim 3 wherein said second sub-assembly is movable in a back-and-forth direction relative to said floor means for adjustments to the position of said second sub-assembly.

5. The apparatus of claim 4 wherein said second sub-assembly includes wheel means thereon that engage rail means in said floor means, said wheel means being adapted for movement along said rail means for said adjustments to the position of said second sub-assembly.

6. The apparatus of claim 5 wherein said second sub-assembly additionally includes actuator means for causing said second sub-assembly to move back and forth along said rail means.

7. The apparatus of claim 6 wherein said actuator means comprise selectively operable hydraulic cylinders.

8. The apparatus of claim 1 wherein said second sub-assembly is adapted to removably support tubing injector means thereon.

9. The apparatus of claim 1 wherein said first sub-assembly includes derrick means pivotable between a first lowered storage position and a second raised operating position.

10. The apparatus of claim 1 wherein said platform means are adapted to encompass the wellhead of said bore hole and any blow out preventer means thereon with either said derrick means or said tubing injector means positioned directly overhead of said wellhead.

11. The apparatus of claim 1 wherein said platform means are adapted for movement over the surface of the earth.

12. The apparatus of claim 1 wherein said first and second sub-assemblies are collapsible on said platform means for movement of said platform means over roadways.

* * * * *